US005239986A

United States Patent [19]

Hermelin

[11] Patent Number: 5,239,986

[45] Date of Patent: Aug. 31, 1993

[54] METHOD OF NORMALIZING SOFT TISSUE DYSFUNCTION

[76] Inventor: Arnold Hermelin, Route 2, Box 647, Summerland Key, Fla. 33042

[21] Appl. No.: 793,109

[22] Filed: Nov. 18, 1991

[51] Int. Cl.[5] ..... A61H 1/00

[52] U.S. Cl. ..... 128/24 R; 128/898

[58] Field of Search ..... 128/24 R, 898

[56] References Cited

PUBLICATIONS

Tappan, Healing Massage Techniques: A Study of Eastern and Western Methods, 1978, Reston Publishing Co., pp. VII, 31-51, 57-60.

*Primary Examiner*—Robert A. Hafer
*Assistant Examiner*—Brian E. Hanlon
*Attorney, Agent, or Firm*—Polster, Lieder, Woodruff & Lucchesi

[57] ABSTRACT

A process of normalizing soft tissue in a human subject by a therapist includes the steps of locating dysfunctional soft tissues in the body of the subject, lightly palpating the area in such a way as to detect restrictions in the skin, detecting rope-like barriers or patterns, sensing the potential movement of the patterns, allowing the presence of the therapist's fingers to stimulate movement of the patterns, following the movement with the fingers of the therapist without applying substantial force, so that the presence of the therapist's fingers against the patterns continues to stimulate movement without forcing the movement, until the dysfunctional soft tissues are normalized

7 Claims, 1 Drawing Sheet

THUMBS TOUCHING

STARTING POSITIONS

THUMBS TOUCHING

OVER & UNDER

CROSSED WRISTS

BACK TO BACK

METHOD OF NORMALIZING SOFT TISSUE DYSFUNCTION

BACKGROUND OF THE INVENTION

The body has a basic desire to be in a state of physiological balance. One normally recognizes an imbalance as pain or limitation of movement. This pain and imbalance is frequently associated with soft tissue dysfunction. The method of this invention is based upon the observations that soft tissue dysfunction, no matter how deep within the body, is reflected by patterns in the skin. Normalizing those patterns has the multi-dimensional effect of normalizing the corresponding soft tissues. Also, unless the patterns in the skin are released, normalization of the soft tissue which corresponds to those patterns, is, in effect, blocked. Further, when addressing the muscles specifically, releasing crossed patterns at the attachments of a muscle will effect the release of the entire muscle.

The method of this invention is intended for use by, and the description of it is intended to be directed to practitioners trained in therapeutic massage and/or trained in the method of this invention by a practitioner trained in therapeutic massage. These practitioners are referred to hereinafter as therapists. The method is described as applied to human subjects, and that is its preferred application, but the technique can also be applied to the treatment of animals.

One of the objects of this invention is to provide a method of normalizing soft tissue dysfunction in a body, so as to alleviate pain or relieve limitation of movement, by releasing and normalizing patterns in the skin that reflect soft tissue dysfunction which in turn normalizes the soft tissue that is associated with the patterns.

SUMMARY OF THE INVENTION

In accordance with this invention, generally stated, preferably after a human subject is interviewed to determine orally as much information as is possible about the condition of the subject in respect to areas of pain or discomfort, an analytical examination in which the therapist considers visually any postural abnormalities or other visual signs that may be helpful, and a palpatory examination using deep palpation to reveal contractions, bunching, ropiness, and the like in the soft tissues (muscles, tendons, ligaments, fascia, and aponeurotic tissue), the latter palpation combined with the subject's determination of the degree of tenderness on a scale agreed upon between therapist and subject, the method of this invention is begun. It involves light palpation, consisting of a sweeping motion along the surface of the skin and is very gentle Its purpose is to let the therapist become aware of restrictions in the patterns on the skin that are associated with dysfunction in the deeper tissues. Light palpation will reveal an area delineated by a crossing or blockage of patterns called knots. A knot is a light indentation in the skin which feels like a vortex or funnel next to a grain of sand. By moving slightly proximal to the knot and sweeping sensitively with the fingertips in a clockwise or counter clockwise direction, the therapist can feel the rope-like barriers called patterns. By tugging lightly on the knot in a distal direction, the patterns can frequently be seen to radiate from the knot as lines of tension in the tissues. The area is swept with the fingertips to locate the tension point created by the knotting of the patterns. When a knot is located, the finger pressure applied is very light, and the therapist can sense the potential movement of the patterns. The presence of the fingers of the therapist in this mode converts the potential movement of the patterns into balance-producing movement That movement is not merely along a single plane on the surface of the skin but is an expansive movement as if the tissues beneath the fingers are actually expanding from the inside. In performing the method, the therapist must be careful to allow the balance-producing movement to take place, never forcing or directing the movement, allowing the close, constant contact of the fingers with the patterns to stimulate movement of the patterns, and then following closely along with the movement so as to continue to supply the necessary stimulation for the movement to continue.

DESCRIPTION OF THE PREFERRED EMBODIMENT

In the preferred method of this invention, after the preliminary evaluation which has been described above, that includes an interview or auditory portion, an analytical exam or visual portion, and a palpatory exam or kinesthetic portion, initially with deep palpation, the therapist begins by conducting a light palpation consisting of a sweeping motion along the surface of the skin, very gently. By such a technique, the therapist becomes aware of restrictions in the patterns on the skin that are associated with dysfunction in the deeper tissues The amount of pressure to be applied is determined by the resistance of the tissues against the hand, as if one were pushing on a zip-lock bag filled with air. The pressure is correct when the subtle force of the tissues expanding outward is felt, as if the bag were pressing against the fingers, rather than the fingers pressing against the bag. The patterns in the tissues feel like channels or ropes in the skin, and move in response to the presence of the fingertips. The movement may not be immediate, and may be very subtle at first, requiring that the therapist first wait for the movement, and then move very slowly and perhaps return to the starting point several times before the patterns have released enough to permit more complete movements. If the fingers are returned to the starting point they should be lifted off the body prior to the return rather than to be moved along the surface of the skin. The therapist's hands and the entire body must be very relaxed. Once movement in the patterns has begun, the fingers can then follow the movement of the patterns in the tissues rather than the fingers forcing movement, until the patterns are no longer crossed and the deep tissues normalize.

Figure 1:
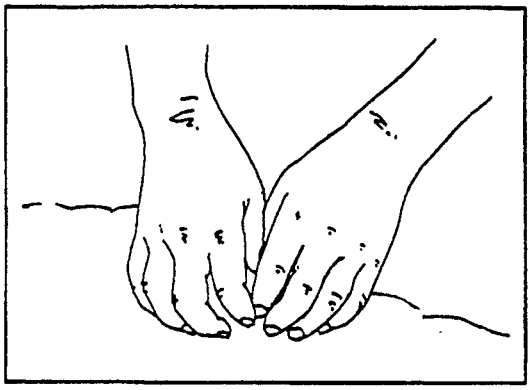
FIGS. 1–4 illustrate starting positions of the hands of the therapist.
Figure 2:
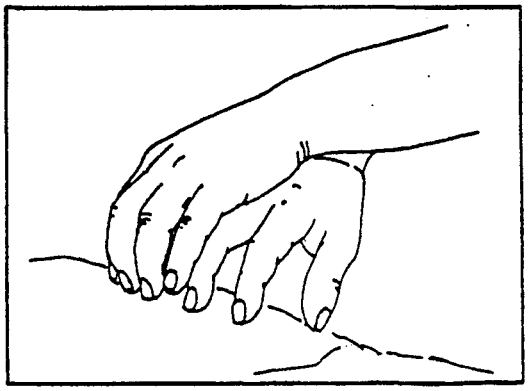
Figure 3:
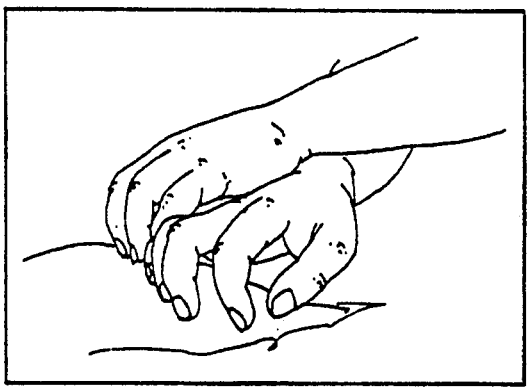
Figure 4:
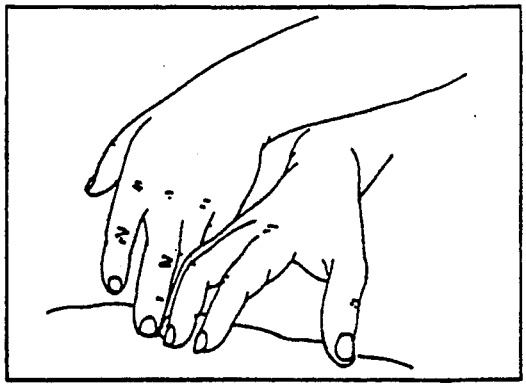

To understand the effect of the presence of the therapist's fingers in stimulating movement of the patterns, if one stands, puts his hands into the starting position shown in FIG. 1, with the thumbs crossed and the hands nestled into each other and the fingers curved as if to type, places his fingertips on a table and allows the fingers to relax, one can feel a pulsating and tingling in the fingers; with slightly more relaxation of the touch, the fingers tend to jump or move in small increments against the non-moving table surface. It is this sort of force, after the dysfunctional soft tissues have been identified, that stimulates the movement of the patterns, which precedes following of the movements, which in any event leads to the relaxation of the constricted areas. Of course, unlike the table example, there are no jumping movements when the fingers are placed on the skin, because there is movement which is inherent in the tissues which is not present in the table.

By following the movement of the pattern without any application of force, will or preconceived movements by the therapist, until the movement has run its course, the restrictions are released, and the deeper tissues are brought into a stage of physiological balance or homeostasis. This will manifest itself in the relief of pain, or even a beneficial re-alignment of the body of the subject, if the dysfunction has resulted in a misalignment.

Having thus described the invention, what is claimed and desired to be secured by Letters Patent is:

1. A process of normalizing soft tissue dysfunction in the soft tissues of a living subject comprising placing the fingers along gently on the skin of said subject, detecting restrictions in the skin in the form of knots said knots being slight indentations in the skin indicating a crossing of rope-like barriers; waiting for movement of said patterns to begin in response to the presence of said fingers; and following said movement with said fingers, as the presence of the fingers stimulates movement to continue, without forcing or directing said movement or predetermining the direction of said movement along the skin, until the dysfunctional areas in the soft tissues of the subject normalize.

2. The process of claim 1 wherein said detecting restrictions in the skin of the subject includes deep palpation.

3. The process of claim 1 wherein the subject is a human subject and the dysfunction in the tissue is determined by an evaluation procedure, comprising an interview, an analytical examination and a palpatory examination.

4. The process of claim 1 wherein the effect of normalizing the dysfunctional soft tissues is to alleviate pain in the body of the subject.

5. The process of claim 1 wherein the effect of normalizing dysfunctional soft tissues is to cause structural change to take place in the alignment of the body of the subject.

6. A process of alleviating pain in a human subject comprising locating tight and constricted areas of the body of the subject, lightly palpating the body of the subject by placing the fingers gently on the skin and moving them in a sweeping motion, detecting restrictions in patterns in the skin; waiting for movement of said patterns to begin in response to the presence of said fingers; and following said movement with said fingers along, without applying substantial force into the tissues, as the presence of the fingers stimulates movement to continue, without forcing, directing or predetermining the direction of the movement along the skin, until the constricted area is relaxed.

7. The process of claim 6 wherein said locating tight and constricted areas of the body of the subject includes deep palpation.

* * * * *

UNITED STATES PATENT AND TRADEMARK OFFICE

CERTIFICATE OF CORRECTION

PATENT NO. : 5,239,986

DATED : August 31, 1993

INVENTOR(S) : A. Hermelin

It is certified that error appears in the above-indentified patent and that said Letters Patent is hereby corrected as shown below:

Column 3, line 20, delete "along" and insert -- alone --.
Column 4, line 24, delete "along" and insert -- alone --.

Signed and Sealed this

Sixteenth Day of August, 1994

Bruce Lehman

*Attest:*

BRUCE LEHMAN

*Attesting Officer*

*Commissioner of Patents and Trademarks*